US008495871B2

(12) United States Patent
Bitter

(10) Patent No.: US 8,495,871 B2
(45) Date of Patent: Jul. 30, 2013

(54) HYDRAULIC SYSTEM

(75) Inventor: Marcus Bitter, Mannheim (DE)

(73) Assignee: Deere & Company, Moline, IL (US)

( * ) Notice: Subject to any disclaimer, the term of this patent is extended or adjusted under 35 U.S.C. 154(b) by 907 days.

(21) Appl. No.: 12/631,409

(22) Filed: Dec. 4, 2009

(65) Prior Publication Data

US 2010/0154404 A1 Jun. 24, 2010

(30) Foreign Application Priority Data

Dec. 18, 2008 (DE) ..... 10 2008 054 880

(51) Int. Cl.
*F15B 11/02* (2006.01)
*F04B 49/00* (2006.01)

(52) U.S. Cl.
USPC ..... 60/449; 60/443

(58) Field of Classification Search
USPC ..... 60/329, 443, 445, 449
See application file for complete search history.

(56) References Cited

U.S. PATENT DOCUMENTS 5,155,996 A * 10/1992 Tatsumi et al. ..... 60/452
6,655,135 B2 * 12/2003 Oka ..... 60/329
2007/0012039 A1 * 1/2007 Takebe ..... 60/449

* cited by examiner

*Primary Examiner* — Thomas E Lazo

(57) ABSTRACT

A hydraulic system includes an engine driven adjustable hydraulic pump which supplies fluid to a hydraulic consumer, and an electronic control unit. The adjustable pump includes flow controller for controlling a pressure difference between the consumer and the adjustable pump to a pre-determined control pressure difference. The flow controller includes an actuator controlled by the control unit, through which the pressure difference can be controlled. The electronic control unit receives an engine speed signal and controls the actuator to control the pressure difference, in order to make power delivery of the adjustable pump conform to the operating conditions of a vehicle.

8 Claims, 3 Drawing Sheets

HYDRAULIC SYSTEM

FIELD OF THE INVENTION

The present invention relates to a hydraulic system for an engine driven vehicle.

BACKGROUND OF THE INVENTION

Agricultural machines such as tractors, construction machines loaders or other types of operating machines, typically have a hydraulic system with which one or more hydraulic consumers such as hydraulic cylinders, hydraulic motors or other hydraulically driven components. Such hydraulic systems include hydraulic pumps that can be connected directly or over a connecting gearbox with fast or slow fixed gear ratios to the drive shaft of a drive engine. Thereby the maximum volume flow that can be conveyed by the hydraulic pump varies with the rotational speed of the drive engine. The faster the rotational speed of the drive engine the larger is the volume flow that can be conveyed by the hydraulic pump. In adjustable load-sensed controlled hydraulic pumps, so called adjustable pumps, as they are being applied today in the state of the art, the maximum volume flow conveyed can be made to conform to the demand of the hydraulic consumers. This is performed usually over a so-called conveyed volume-flow-controller that controls or maintains a predetermined control pressure difference between the pressure of the outlet of the adjustable pump and the load sensing signal (in the following called LS-signal). The conveyed volume flow controller of a LS-controlled adjustable pump now operates in such a way that it adjusts the conveyed volume flow of the adjustable pump in such a way that the predetermined control pressure difference, that can be adjusted on the conveyed volume flow controller can be provided as an input by means of an adjusting spring and is maintained constant at all times. The exact method of operation of such a pressure-based volume flow controller can be reviewed in the relevant literature and as such is the state of the art.

The conveyed volume flow that can be delivered by a hydraulic valve to a hydraulic consumer depends directly upon this control pressure difference. A certain control pressure is adjusted by means of the adjusting spring and an adjusting piston of the conveyed volume flow controller in that it forces the adjustable pump to maintain a control pressure difference corresponding to this adjusted pressure between the outlet of the adjustable pump and the consumer (L-S Signal). In order to attain this control pressure difference, it pivots the conveyed volume flow control adjusting unit upward in order to begin to convey a corresponding conveyed volume flow that can be controlled or adjusted as a function of the adjusting piston. Here the adjusting piston is connected hydraulically with the conveyed volume flow controller and changes its position as a function of the control pressure difference existing or provided as input at the conveyed volume flow controller. The conveyed volume flow control unit may for example include a pivoting disk that is connected with a control or lifting piston where the rotating movement of the pivoting disk is converted into a linear movement of the lifting piston. The conveyed volume flow conveyed by the adjustable pump flows through the lines and the valves of the hydraulic system and thereby generates certain pressure losses in the lines and each of the valves leading to the consumer. The pressure that then develops behind the valves or at the consumer is reported back as load pressure (LS-signal) to the adjusting pump (over a load sensing line (L-S-line) that is connected to the conveyed flow controller) and impels the adjustable pump to convey such an amount of flow that the pressure at the outlet of the adjustable pump is higher by the control pressure difference than the pressure at the consumer delivered by the L-S-Signal.

The further a valve now is from the adjustable pump, the higher are the pressure losses occasioned by the longer lines, which leads to the effect, that valves that are located further away from the adjustable pump than other valves, permit less volume flow to reach the consumer, although those valves are configured identically. In order to compensate for this effect, a known practice is to apply valves that transmit an increased load signal to the pump, as is disclosed for example in EP 176 0 325 A2.

Accordingly a simplified conclusion is that a certain pressure is required to force a certain volume flow through a line and/or a valve. Since the pressure losses increase during the flow through the lines or valves, it would therefore be advantageous to maintain the cross sections and the conduct of the lines and the bores as large as possible, as well as keeping the losses over the valves as low as possible by the configuration if a certain volume of hydraulic fluid is to be provided to a consumer. If the losses become too great and thereby the volume flow is reduced, this can be compensated for by increasing the cross section of the valve openings, in other words, by changing the cross section at the valve openings, volume flows can be changed, that is, they can be increased or decreased.

Other possibilities of changing the volume flow lead to a change in the adjusting force provided at the conveyed volume flow controller of the adjustable pump. In that way, EP 0 439 621 B1 discloses that for a precision operation of the hydraulic system, the control pressure difference at the adjustable pump can be reduced by manual operation of an adjustable force at the conveyed volume flow controller, which results in a lower maximum volume flow in the hydraulic system or in the valves.

Now the problem is that is that it may be advantageous for environmental or economical reasons to operate a hydraulic system of an operating machine in the lower range of rotational speeds. This has the result that with today's adjustable pump sizes too little volume flow is available for the applications, which leads to the application of larger adjustable pumps, so that large volume flows can be conveyed at low engine rotational speeds. This results in turn in very large volume (not utilized) flows being conveyed at high engine rotational speeds that lead to very large power losses in the overall power balance. These problems could be overcome at least partially, by raising the control pressure difference of the pump, that finally would lead to a higher fuel consumption of the machine, since a certain power output is required, or a certain conveyed volume flow is required, in order to attain the necessary control pressure difference. Moreover the possibility exists of designing all lines and valves for the maximum pump power output that would in turn lead to very high cost for the individual components and to space problems on the operating machine. EP 349 092 B1 discloses a further possibility, to permit possible high volume flows at low engine rotational speeds, but to limit the volume flow at high engine or rotational speeds. Here the maximum conveyed volume flow of the adjustable pump is limited, where the conveyed volume flow amount of the adjustable pump is measured or monitored (for example, by a measurement of the position of the conveyed volume flow control mechanism, for example the adjustment angle of an adjusting disk or a pivot disk). These adjustable pumps and the corresponding electronic control systems however are costly and expensive.

SUMMARY OF THE INVENTION

Accordingly, an object of this invention is to provide a hydraulic system that makes available a large conveyed volume flow at low drive rotational speeds, which however is limited to a certain maximum value at higher rotational speeds.

This and other objects are achieved by the present invention, wherein a hydraulic system is configured so that the conveyed volume flow controller includes an actuator that can be controlled by a control unit, by means of which the control pressure difference can be varied by the electronic control unit at the conveyed volume flow controller, where the electronic control unit detects a signal dependent upon the drive rotational speed, as a function of which a control signal can be generated by the control unit for the controllable actuator, which varies the control pressure difference at the conveyed volume flow controller. In order to detect the drive rotational speed and generate a corresponding control signal for the actuator that can be remotely controlled a predetermined control pressure difference at the conveyed volume flow controller can be purposefully varied as a function of the drive rotational speed.

That is, that at a low drive rotational speed the control pressure difference for example amounts to P=P1 bar. This adjustment is useful, for example, to convey a volume flow up to a magnitude of V1 1/min through the valves. The adjustable pump, however, on the basis of its maximum conveyed volume flow, has the possibility of conveying conveyed volume flows of Vmax 1/min that would result in high losses in the lines and the valves. At idle rotational speed this pump now conveys, for example, a maximum volume flow of V idle 1/min (V idle<V1<Vmax) and with increasing rotational speed (U+) the conveyed volume flow (V) increases. Now it is conceivable that upon reaching the V1 1/min limit the control pressure difference P bar is reduced further (P=P1−P(U); where P(U) is to be understood as a function of the drive rotational speed and increases with increasing drive rotational speed) and thereby also reduces the conveyed volume flow of the adjustable pump, so that at maximum drive rotational speed of, for example, Vmax U/min, V (1) 1/min is conveyed by the adjustable pump at all times. If the drive rotational speed drops again, the control pressure difference is again increased and therewith a conveyed volume flow again increases slowly (P=P1−P (U); where P (U) is reduced with a reducing drive rotational speed) until the original value (P=P1) has again been reached. The corresponding functions and calculation algorithms are preferably stored in memory in the electronic control unit. A corresponding control signal is generated by the control unit and is conducted to the actuator at the conveyed volume flow controller for purposes of control of the same. The control pressure difference is changed at the conveyed volume flow controller by controlling the actuator.

When a predetermined drive rotational speed value is exceeded the control pressure difference of the adjustable pump can be reduced. Here the predetermined drive rotational speed that triggers the readjustment of the control pressure difference can be provided as input depending on the application preferably over an input module on an operator's display of an operating implement or over another appropriate input interface of the control unit. However, depending on the magnitude of the power of the adjustable pump, a fixed drive rotational speed can be provided and stored in memory in the control unit.

When a predetermined drive rotational speed is exceeded the control pressure difference can be changed proportionally to the drive rotational speed, where the control arrangement reduces the control pressure difference with increasing drive rotational speed and increases it with reduced drive rotational speed. With respect to this the control signal generated by the control unit preferably conforms uniformly to a change in the drive rotational speed, so that the operator of the system does not directly sense the change in the conveyed volume flow.

For special applications provision is made for utilizing the maximum possible conveyed volume flow of the adjustable pump. For this purpose adjusting devices are provided as a function of which a control signal can be modified and the control pressure difference can be changed by means of the adjusting devices, in such a way that the control pressure difference can be reduced or increased independently of the drive rotational speed. In that way an operator can quasi "override" the control of the adjusting devices taken over from the control arrangement at the conveyed volume flow controller and deactivate the control function of the control unit that is dependent upon the drive rotational speed by corresponding input at the adjusting devices, for example, at an input module or an input button with an adjusting wheel or a potentiometer, and modify the control signal by a direct input of an input signal that can be provided so that the signal provided by the adjusting devices is prioritized despite a control signal originally generated that was proportional to the drive rotational speed. Thereby it is possible to circumvent a control dependent upon the drive rotational speed and to operate the hydraulic system with a high control pressure difference, or to adjust any desired control pressure difference at any desired rotational speed. There are particular applications in which the operator would like to necessarily utilize the maximum conveyed volume flow of the adjustable pump regardless of the power losses. Such an application would, for example, be a front loader in which the operator would like to attain the shortest possible cycle times and with that more (turnover) power. In such a case an adjustable pump with a large conveyed volume flow would not help as long as all the lines and valves are not also increased. Here it may be useful to purposely increase the control pressure difference in order to assure that the adjustable pump can fully conform in order to convey a greater volume flow.

Here the hydraulic system can also include a temperature sensor that detects the temperature in the hydraulic system and delivers a corresponding signal to the control unit. In particular since the viscosity of the hydraulic fluid is a function of the temperature, so that it may be advantageous at low temperatures or at a high viscosity of the hydraulic fluid to adjust the control pressure difference in the conveyed flow controller as a function of the viscosity or the temperature, for example, to raise it. Moreover it may be advantageous at extremely low temperatures to counteract cavitations problems caused by the viscosity, so that the control pressure difference at the conveyed volume flow controller is limited or reduced and an increase occurs only at a certain temperature and particularly independently of or dependent upon the drive rotational speed. Similarly it may be advisable to make the control pressure difference at the conveyed volume flow controller conform to the lower flow losses at higher temperatures, that is, for example, to reduce it. In that way conditions may occur for which an adjustment of the control pressure difference at the conveyed volume flow controller is advantageous as a function of the drive rotational speed alone as well as in combination with the temperature in the hydraulic system. Such control functions or control algorithms may be implemented in the electronic control unit and stored in memory as corresponding condition diagrams. On the basis of these control functions or control algorithms corresponding control signals can be generated at the conveyed flow controller as a function of the drive rotational speed as well as the temperature for the control of the adjusting devices or for the adjustment of the control pressure difference.

The actuator at the conveyed volume flow controller include, for example, an electric motor, that can be controlled by the control unit and can adjust the adjusting spring in the conveyed volume flow controller. Moreover, it is also conceivable that an electro magnet be applied that can adjust the adjusting spring in the conveyed volume flow controller. Preferably the adjustment of the conveyed volume flow controller or of the adjusting spring can be performed directly at the pre-load of the adjusting spring of the conveyed volume flow controller. As already described above, this adjustment can be performed electrically or electromagnetically, but also hydraulically, pneumatically or purely mechanically, where an electric or electromagnetic adjustment is preferred, since this can be handled more readily compared to other means of adjustment. This adjustment can now increase or decrease the spring pre-load which automatically adjusts the control pressure difference. This adjustment may be performed, for example, by means of proportional magnets that are effective in both directions. Obviously it is also conceivable to permit an adjustment in only one direction. Since it is always possible that the electronic system at the operating vehicle fails, it is useful to provide measures that prevent a failure of the entire hydraulic system in the case of a failure of the electronics. For this reason the application of a stepper motor for the adjustment of the control pressure difference is particularly appropriate. The stepper motor has the advantage that it is provided with a certain self-locking arrangement and can be operated very precisely into a certain position (adjusting angle), that it does not leave unless it is provided with a new control signal or a very strong force is applied. Such a stepper motor can be connected simply to the adjusting screw for the adjustment of the control pressure difference of the conveyed volume flow controller and can adjust the adjusting screw very precisely and very rapidly depending on the control signal, so that the control pressure difference can be adjusted very sensitively. In the case of a failure of the electronics the stepper motor would simply remain in its last position and thereby assure that a certain minimum operation of the hydraulic system is assured.

The hydraulic system, according to the invention, is applied in operating vehicles that are used in agriculture, that is, in agricultural vehicles, such as tractors, with or without front loaders as well as telescopic front loaders. Moreover, such a hydraulic system is also appropriate for application in construction machines, for example dredges or wheel loaders.

The hydraulic system, according to the invention, permits optimum operation of a hydraulic system in all operating conditions for the drive of the vehicle and is used in particular to reduce power losses and to make available large volume flows at low drive rotational speed. If necessary, very large conveyed volume flows are possible despite small line cross sections and valves. It is thereby possible to retain the existing valves and lines without the need for a larger adjustable pump. Moreover, in the case of failure of the electrical system assurance can be provided despite electronic control of the conveyed volume flow electronic controller that the existing hydraulic system continues to be available.

DESCRIPTION OF THE PREFERRED EMBODIMENT

Figure 1:
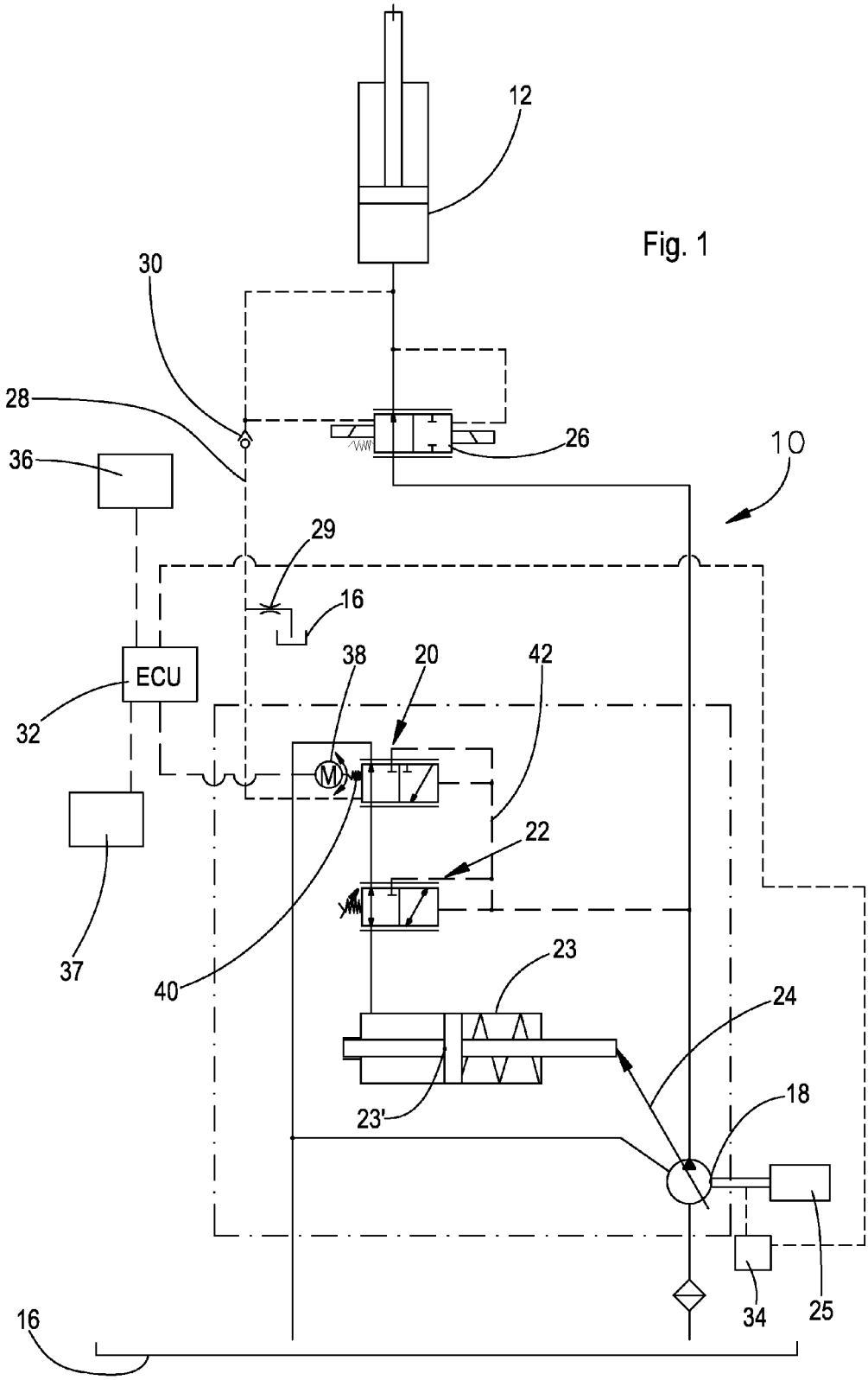
FIG. 1 is a hydraulic circuit diagram of a hydraulic system according to the invention with an electric motor as an adjusting device.

Referring to FIG. 1, a hydraulic system 10 operates a hydraulic consumer 12, for example, a hydraulic cylinder for raising and lowering a front loader 14. The hydraulic system 10 includes a hydraulic reservoir 16, an adjustable hydraulic pump 18 with a conveyed volume flow controller 20 for controlling a pressure difference between adjustable pump 18 and the consumer 12, a pressure limiter 22 to limit the operating pressure for the adjustable pump 18, as well as an adjustable piston 23 for the adjustment and limitation of the conveyed volume flow of the adjustable pump 18, that can be adjusted by a conveyed volume flow adjusting arrangement 24. Moreover, a stop 23 or an adjustable spindle, is provided for the adjustable piston 23, that can be brought into engagement with the adjustable piston 23 and with which a maximal conveyed volume flow of the adjustable pump 18 can be adjusted. The adjustable pump 18 is driven by an internal combustion engine 25. A hydraulic control valve 26 is provided between the consumer 12 and the adjustable pump 18 by means of which the hydraulic consumer 12 can be controlled. A load pressure line 28 is connected between the consumer 12 and the control valve 26 that is connected with the conveyed volume flow controller 20, where the load pressure line 28 is provided with a pressure relief orifice 29 connected to the reservoir 16 and a check valve 30 closing in the direction of the consumer 12, where the check valve 30 is arranged between pressure relief orifice 29 and the consumer 12. Moreover, the hydraulic system 10 includes an electronic control unit 32 that is connected with rotational speed or engine speed sensor 34 and an operator control device or adjuster 36. The conveyed volume flow controller 20 is provided with actuator 38 that are configured as an electric motor, preferably as a stepper motor and can be controlled by the electronic control unit 32.

The engine 25 is directly connected with the adjustable pump 18, where these are here represented only as examples. Obviously, here step-up gears or reduction gears can also be inserted. The drive shaft of the engine 25, which also could be an electric motor, is directly provided with the rotational speed sensor 34 that conducts a rotational speed signal to the electronic control unit 32. Moreover, the electronic control unit 32 can receive input signals from the operator control 36, which it then considers in the generation of control signals for the actuator 38. In the generation of a control signal, a rotational speed signal delivered by the rotational speed sensor 34 is considered primarily as a function of which the electronic control unit 32 generates the control signal for the actuator 38. If, however, an additional input is provided over the input device 36, then the control signal that is based on the rotational speed signal is modified. This has the background that no rotational speed dependant control of the actuator 38 is to occur in the conveyed volume flow controller 20 that can be signaled by an operator over the input device 36 but rather input control magnitudes can be provided as input by the operator for the control of the actuator 38. For example, the operator can provide as input over the actuator 38 the maximum conveyed volume flow value or another adjustable conveyed volume flow value for the adjustable pump 18 that is to be adjusted independently of the rotational speed of the drive engine 25 by the electronic control unit 32.

The conveyed volume flow controller 20 that is initially adjusted over a pre-load spring 40 with a fixed control pressure difference value can now be adjusted by readjusting the pre-load of the pre-load spring 40 over the actuator 38 so that the control pressure difference can be raised as well as lowered. Depending on the existing pressure relations of the system pressure existing between the control valve 26 and consumer 12 and the system pressure existing at the outlet of the adjustable pump 18 the result is a pressure difference that is provided as input to the conveyed volume flow controller 20 over the load sensing pressure line 28 and over a control pressure line 42. According to the initially adjusted control pressure difference, the adjusting piston 23 was brought into a corresponding control position; it is connected with the control pressure regulator 20 over the pressure limiter 22. Corresponding to the control position of the adjusting piston 23, in turn, the conveyed volume flow adjusting arrangement 24 of the adjustable pump 18 is adjusted. Hence the conveyed volume of the adjustable pump 18 is controlled or regulated, that is over the control pressure difference value adjusted at the conveyed volume flow controller 20. The control pressure difference at the control pressure regulator 20 can be adjusted by means of the pre-load spring 40 over the actuator 38, the control pressure difference is adjustable and therewith can be controlled or adjusted or regulated. Thereby an adjustment of the actuator 38 at the conveyed volume flow controller 20 and thereby the conveyed volume of the adjustable pump 18 can be performed as a function of the signal delivered by the rotational speed sensor 34.

Preferably for that purpose threshold values are implemented or deposited in memory in the electronic control unit 32, on the basis of which a corresponding control program can be started, so that, for example, upon reaching a predetermined rotational speed of the engine 25 the pressure difference can be reduced further, in order to reduce the conveyed volume correspondingly and to limit the conveyed volume flow.

Now an operator can "level off" or "over steer" the predetermined threshold values over the input device 36, so that a free determined control of the actuator 38 can be performed regardless of the rotational speed by means of the input device 36. For example, the control pressure differential can be set upon a constant value by means of the input device 36, where the control arrangement 32 performs the control of the actuator 38 regardless of the rotational speed of the drive engine 25. The input device 36 then may include several designated switches or an input display or an adjustable potentiometer, with which adjustment magnitudes can be provided as input. Moreover, an activation or deactivation of the control of the conveyed volume flow controller 20 can be performed by means of the input device 36.

As already mentioned the temperature sensor 37 detects the temperature of the hydraulic fluid and delivers a corresponding temperature signal to the control unit 32. The control unit 32 can now change or control or regulate the control pressure difference at the conveyed volume flow controller by adjusting the actuator 38 as a function of the rotational speed alone or in combination with the temperature. In that way, the control pressure difference at the conveyed volume flow controller can be reduced or increased in addition as a function of the temperature of the hydraulic fluid of the hydraulic system 10. Correspondingly control signals can be generated by control functions or control algorithms implemented in the control unit 32 as a function of the drive rotational speed and/or the temperature.

Figure 2:
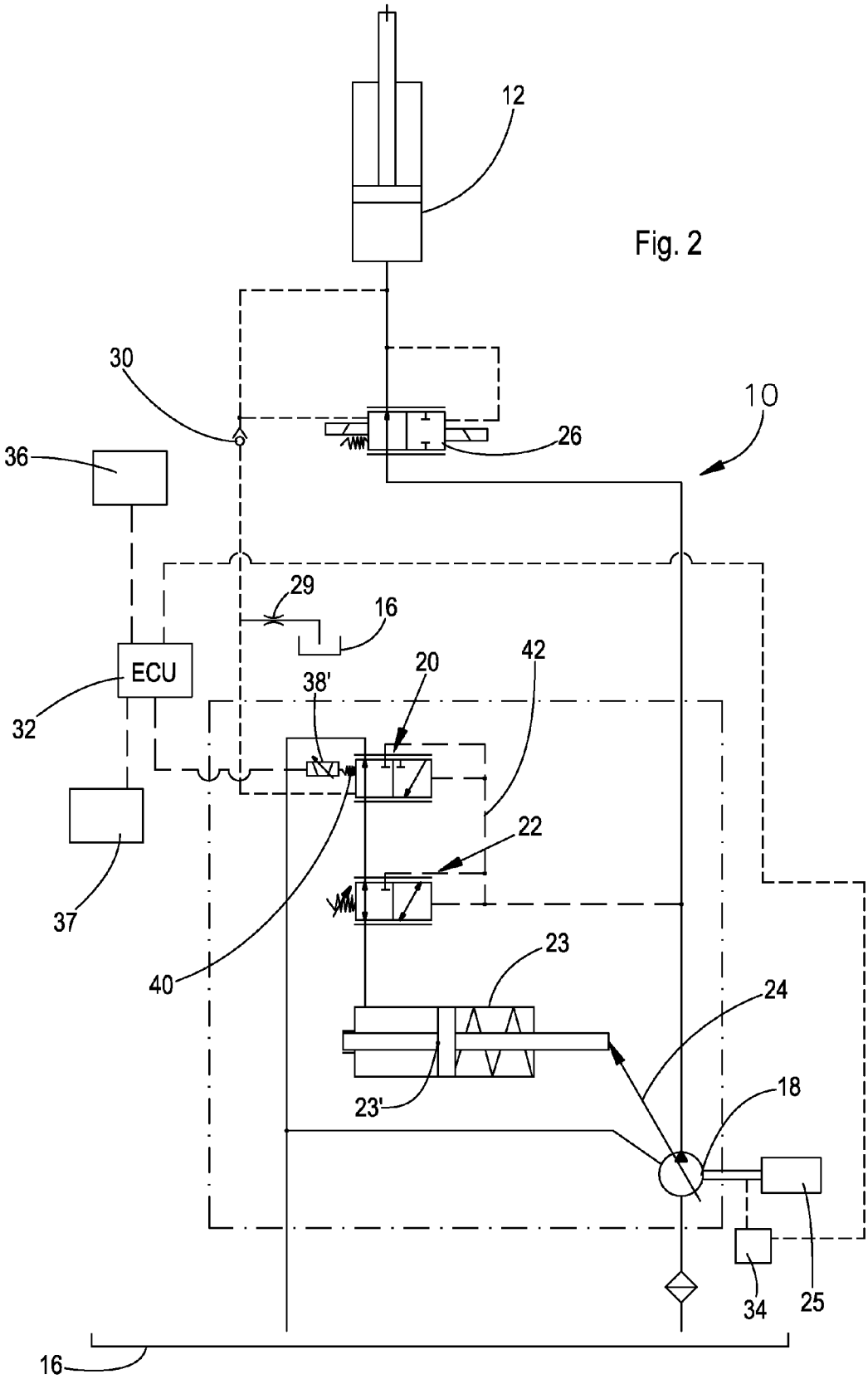
FIG. 2 is a hydraulic circuit diagram of an alternative hydraulic system with a proportional valve as adjusting device.

In an alternative embodiment of the invention shown in FIG. 2, in place of the electric motor 38 shown in FIG. 1, an electromagnetic proportional magnet 38' is shown in FIG. 2. The proportional magnet 38' is preferably effective in both directions where generally an adjustment of the conveyed volume flow controller 20 is entirely conceivable in only one direction, so that, for example, only one reduction of the control pressure difference is possible.

Figure 3:
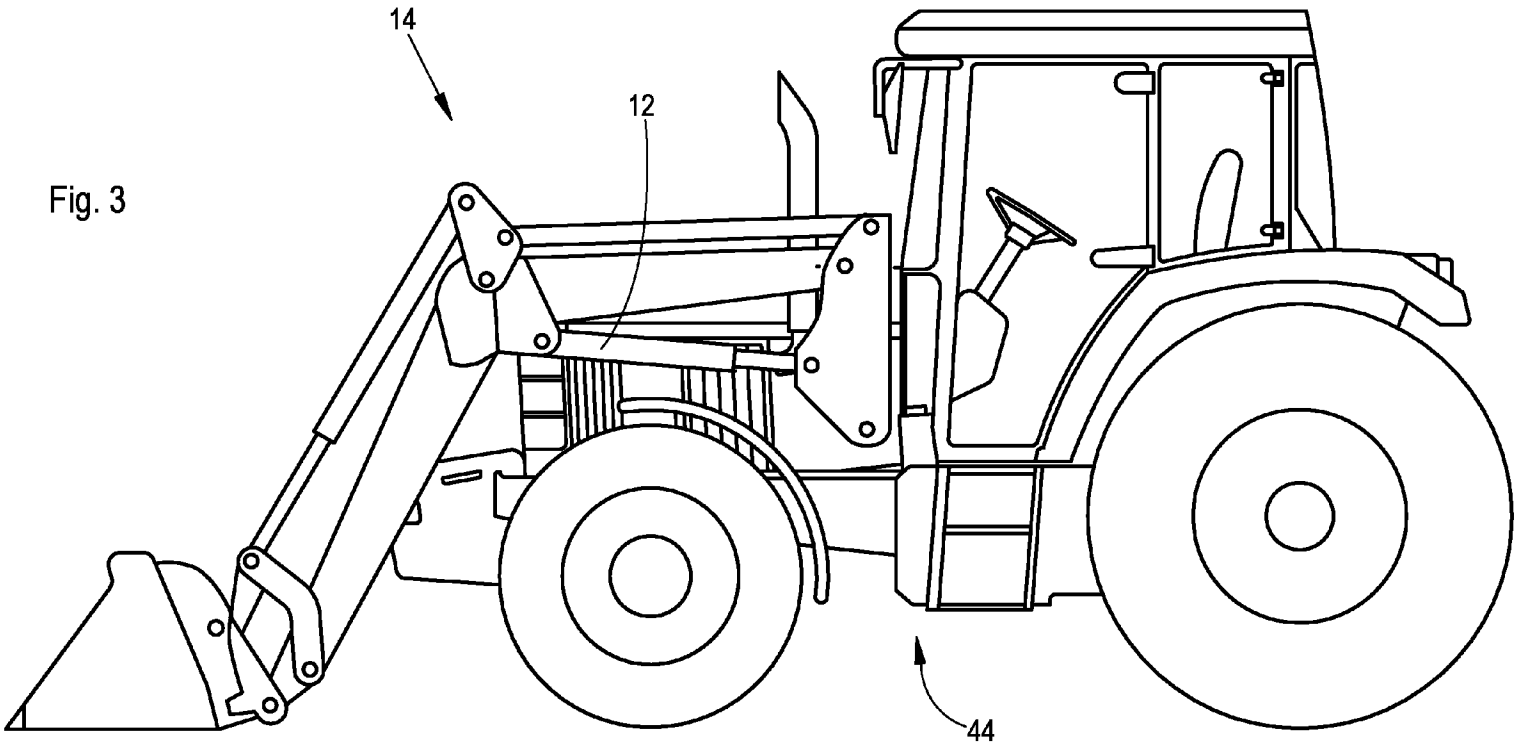
FIG. 3 is a side view of a vehicle with a hydraulic system according to FIG. 1 or 2.

FIG. 3 shows an agricultural vehicle 44 in the form of a tractor that is equipped with a front loader 14 that is operated by a hydraulic system shown in FIG. 1 or 2. Here other applications are conceivable for the hydraulic system, according to the invention, for example for application in construction machines or telescopic loaders. The hydraulic system, according to the invention, can also be used for the supply of other hydraulic consumers not explicitly cited here, for example, for the supply of three point attachment arrangements for agricultural tractors.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

The invention claimed is:

1. A hydraulic system, comprising:

a hydraulic consumer;

an engine driven hydraulic adjustable pump which supplies hydraulic fluid to the hydraulic consumer, the adjustable pump having a volume flow controller which controls a pressure difference between the consumer and the adjustable pump to a predetermined control pressure difference;

an electronic control unit;

a speed sensor for sensing a speed of the engine;

the volume flow controller including a hydraulic actuator controlled by the control unit to vary the pressure difference, and the electronic control unit controls the pressure difference with the actuator as a function of the sensed engine speed, the actuator comprising a piston movable in response to fluid pressure; and the volume flow controller comprising a pair of pressure limiters which are connected in series to a single chamber of the actuator.

2. The hydraulic system of claim 1, wherein:

the electronic control unit reduces the pressure difference when a predetermined engine speed is exceeded.

3. The hydraulic system of claim 1, wherein:

the electronic control unit changes the pressure difference in proportion to the engine speed when a predetermined engine speed is exceeded, and the electronic control unit reduces the pressure difference with increasing engine speed and increases the pressure difference when the engine speed is reduced.

4. The hydraulic system of claim 1, further comprising:

a operator adjusting device connected to the electronic control unit, the electronic control unit varying the pressure difference in response to operation of the adjusting device so that the pressure difference can be varied independently of the engine speed.

5. The hydraulic system of claim 1, further comprising:

a temperature sensor connected to the control unit for sensing a temperature of hydraulic fluid in the hydraulic system, the control unit controlling the volume flow as a function of the temperature of the hydraulic fluid.

6. The hydraulic system of claim 1, wherein:

the actuator comprises an electric motor.

7. The hydraulic system of claim 1, wherein:

the actuator comprises a proportional electro-magnet.

8. The hydraulic system of claim 1, further comprising:

the volume flow controller is connected to a load sensing pressure line and to a control pressure line.

* * * * *